United States Patent [19]

Evans

[11] 3,992,210

[45] Nov. 16, 1976

[54] SILVER HALIDE FILMS WITH CONTROLLED GRADIENT BALANCE

[75] Inventor: Warren William Evans, Highland Park, N.J.

[73] Assignee: E. I. Du Pont de Nemours and Company, Wilmington, Del.

[22] Filed: June 5, 1973

[21] Appl. No.: 367,332

[52] U.S. Cl. ..... 96/69; 96/17; 96/94 R

[51] Int. Cl.[2] ..... G03C 1/76; G03C 7/16; G03C 1/02

[58] Field of Search ..... 96/69, 120, 68, 17, 96/19, 74, 23, 94

[56] References Cited

UNITED STATES PATENTS

| | | | |
|---|---|---|---|
| 1,954,346 | 4/1934 | Capstaff | 96/69 X |
| 2,134,546 | 10/1938 | Barth et al. | 96/69 |
| 2,202,026 | 5/1940 | Renwick | 96/69 X |
| 2,535,370 | 12/1950 | Pohl | 96/17 |
| 3,234,023 | 2/1966 | De Ramaix et al. | 96/74 |
| 3,251,689 | 5/1966 | Hellmig | 96/23 |
| 3,658,536 | 4/1972 | Wolf | 96/69 |
| 3,745,008 | 7/1973 | Hellmig | 96/23 |
| 3,764,330 | 10/1973 | Vary | 96/69 |

*Primary Examiner*—Mary F. Kelley

[57] ABSTRACT

Films in which the various color gradients are particularly balanced in relationship to each other are prepared from sensitized emulsions prepared separately and then either coated as separate layers or mixed just prior to coating. These films are particularly useful as color separation negatives where machine processing is used and where identical processing conditions for each color record are desirable.

9 Claims, No Drawings

SILVER HALIDE FILMS WITH CONTROLLED GRADIENT BALANCE

BACKGROUND OF THE INVENTION

1. Field of the Invention

This invention relates to photographic silver halide materials and systems. More particularly, this invention relates to materials useful for preparing color separation films. Still more particularly, this invention relates to color separation films with color gradients that have a particular relationship or balance to each other. Finally, this invention relates to color separation films wherein the balanced color gradients are achieved under indentical processing conditions.

2. Description of the prior Art

The first step in preparing a printing plate for the multiple reproduction of a colored original involves the photographic recording of the original on so-called "color separation films". In this process, the original image is successively photographed three or more times, each time through a different color (red, green and blue) filter on a new piece of the color separation film. These films are then processed and separate printing plates made therefrom. The plate made from the red filter separation is used to print with cyan ink, the plate from the green filter separation is used to print with magenta ink, and that from the blue filter separation is used to print with yellow ink. When a four-color printing is made, a black filter separation is also made and used to print with black ink. These plates are then used, for example, in offset lithography as taught by Jaffe et al. in "Color Separation Photography", Graphic Arts Technical Foundation, Inc., August 1959. Preparation of the photographic copy, conversion of the color negative image to the color printer plate and the associated systems are fully covered therein. Other processes which use the color separation film are letterpress gravure printing and stencil or screen printing as described by Yule in "Principles of Color Reproduction", John Wiley and Sons (1967). To produce the satisfactory gray balance in the final reproduction, most cyan inks require a slightly higher contrast in the cyan printer (from the red separation film) than in the other printers. Contrast or gradient herein refers to the slope of the sensitometric curve produced from a stepwise image exposure of the film. Ideally, all contrasts should be equal. However, as stated above, it is preferred to have the green and blue contrasts equal but slightly lower than the red to achieve the desired gray balance described above.

In practice, the operator adjusts the developing conditions to achieve the desired gradient balance. Where machines are used to process the photographic element and where film throughput is important, variations in processing time and temperature by adjustment of the machine controls is cumbersome and time-consuming. Additionally, the operator of the machine finds it difficult to exactly adjust the machine parameter from set to set, resulting in reproducibility errors.

Another method for adjusting the color gradient balance is to incorporate a removable light-absorbing filter dye within the emulsion which will artificially lower a particular color contrast by absorbing light in the region of the spectrum to which the color exposure contrast is too high. Such a system is described by Salesin in U.S. Pat. No. 3,531,287. Other effects are noted, however, such as a large loss in emulsion speed.

Additionally, these filter dyes must be totally removable in the processing fluids else they will stain the final record.

It is further known to add a second emulsion layer which has not been optically sensitized in order to raise the blue exposure contrast. This results in a product wherein all of the color contrasts are almost equal as taught by Hellmig in U.S. Pat. No. 3,396,024. However, equal color gradients are not desired by the industry that uses the color separation films, because they cannot achieve the proper tonal relationship.

SUMMARY OF THE INVENTION

It is an object of this invention to provide a novel black-and white silver halide system which will produce a desired gradient balance under identical processing conditions useful in preparing, for example, color separation negatives. A further object is to provide such a system prepared from a series of dye-sensitized emulsions so as to produce the desired gradient for each of the three color separations with no or acceptable changes in speed or other sensitometric effects. Still other objects will be apparent from the following description of the invention and the claims.

These and other objects are achieved by providing a photographic coated element prepared from two separate emulsions or portions of the same emulsion said emulsions or portions containing different spectral sensitizers sensitive to different parts of the spectrum, i.e., sensitizers which do not have absorption maxima in the same spectral region but which may have overlapping absorption curves. These emulsions or portions of emulsion may be mixed prior to coating on a suitable film support or they may be coated as separate layers. By adjusting the amount of emulsion used, depending on the optical sensitizer, it is possible to achieve any desired color gradient balnce under equal processing conditions. Since no filter dyes are used, full sensitometric characteristics are achieved. Although the coating of dual layer emulsions is known, as described above, most of the prior art describes non-optically sensitized layers in combination with other layers.

DESCRIPTION OF THE PREFERRED EMBODIMENTS

Emulsions useful for preparing films for the color separation process are usually of the bromoiodide type, though in the practice of this invention any of the common silver halides (bromide, iodide, chloride)or mixtures thereof may be used.

In one embodiment of this invention, a suitable emulsion is first chemically sensitized (i.e. with gold and sulfur compounds) and divided into two portions. One portion is further optically sensitized with a dye sensitive substantially throughout the visible region of the spectrun, i.e. fully panchromatic, and the other portion with a dye sensitizing much more strongly to the red than green region of the spectrum. The emulsions are then individually coated on a suitable film support with the portion containing a red sensitizing dye preferably coated first. Alternatively, the emulsions may be mixed just prior to coating.

In yet another embodiment, that portion of the emulsion which is to be optically sensitized in the red-blue region of the spectrum is digested from 15% to 60% of the time used to digest the panchromatically sensitized portion. In this embodiment, the portions are then preferably mixed just prior to coating on a suitable film support.

Films made as described above will process under equal conditions and will subsequently produce color separation films, for example, with any desired color gradient balance dependent only on the coating weight of the various layers used or the amount of each portion mixed in the case of single layers. Additionally, films thus made have excellent sensitometric characteristics such as good speed and low fog and do not exhibit residual dye stain.

Any photographic silver halide emulsion can be used to practice this invention. Those preferred are useful for the color separation prcoess where control of color gradient balance is desirable. These films are usually ca. 96 mole percent bromide and ca. 4 mole percent iodide and usually contain a gelatino binder. However, other halides or mixtures thereof as well as other binding agents (e.g. albumin, agar-agar, gum arabic, alginic acid, polyvinyl alcohol, polyvinyl pyrrolidone, cellulose ether, partially hydrolyzed cellulose acetate, alkyl acrylate polymers, or mixtures of one or more of those listed, etc.) may be used equally as well.

The emulsions used are advantageously chemically sensitized by well-known procedures such as by digesting in naturally active gelatins or by adding the sulfur compounds of U.S. Pat. Nos. 1,574,944; 1,623,499;, and 2,410,699. The emulsion can also be treated with the salts and metals described in U.S. Pat. Nos. 2,399,083; 2,448,060; 2,597,856; and 2,597,915 as well as the reducing agents (e.g. stannous salts) of U.S. Pat. No. 2,487,850. Other sensitizing agents and speed increasing adjuvants well-known to those skilled in the art may be also advantageously employed herein.

Spectral sensitization of the emulsions which will be used to produce the desired effects described will depend on the type of emulsion used (e.g. type of halide) and the spectral response desired. Within this wide ambit any of the known spectral sensitizers as described in Mees, "The Theory of the Photographic Process", 3rd Edition (1967), chapters 11 and 12, and others wellknown to those skilled in the art, will function. One only needs to adjust the sensitization conditions for the particular emulsion used with the dye necessary to achieve the speed and spectral response desired. The contrast relationship may then be achieved by mixing emulsions or coating separate layers. Those dyes known as "carbocyanines" are particularly useful. For example a useful combination involves a panchromatic dye having the following structure:

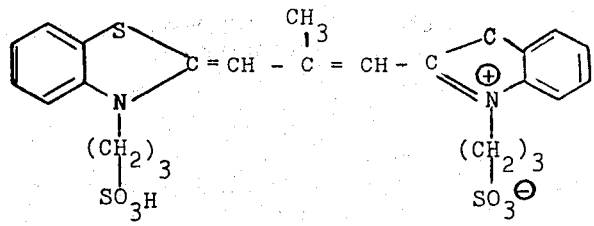

3,3'-disulfopropyl-9-methylthiocarbocyanine and as a high red sensitizer

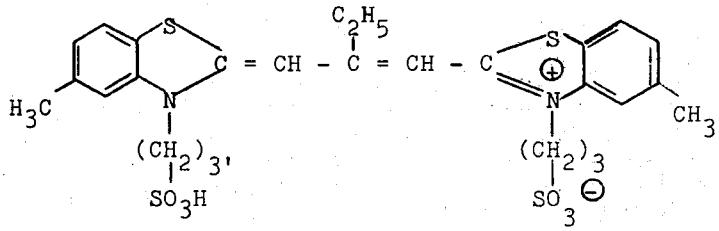

3,3'-disulfopropyl-5,5'-dimethyl-9-ethyl-thiacarbocyanine. These dyes adhere particularly well to silver iodobromide grains, are sensitive, and produce a stable emulsion system.

In practicing this invention an emulsion is prepared from precipitated silver halides and dispersed with a suitable binder. In one emobidment, this emulsion is then chemically sensitized to achieve the optimum or desired sensitometric characteristics, i.e. speed, and then divided into two portions. One portion is further mixed with an experimentally derived amount of a panchromatic sensitizing dye (i.e. dye "A", above) usually dissolved in a suitable solvent (e.g. methanol) while the second portion is further mixed with a suitable amount of a high red sensitizing dye (i.e. dye "B", above), also dissolved in a suitable solvent. After dye sensitization is complete other adjuvants (e.g. wetting and coating aids, hardeners, antifoggants, etc.) are then added and the emulsions coated on a suitable film support (i.e. polyethylene terephthalate prepared and subbed as described in Alles U.S. Pat. No. 2,779,684, Example IV). The portion containing the high red spectral sensitizer is preferably coated first, and the other portion containing the panchromatic spectral sensitizer coated contiguous thereto. Preferably, this elemnet will be overcoated with a thin stratum of gelatin to provide suitable protection for the film handling in subsequent steps. Alternatively, the emulsions made as shown above may be mixed just prior to coating on the support element. By adjusting the coating weights of the individual layers or the amounts of each emulsion mixed in the alternative embodiment, the operator is able to prepare a product which will reproducibly produce an element with any desired color gradient balance. The mixing described herein can be accomplished by thoroughly stirring or blending the two emulsions in a suitable container or by providing a mixing "tee" and metering the emulsions into said "tee" in the desired amount. It is preferred that the mixing be accomplished just prior to coating to prevent dye migration from one group of sensitized silver halide grains to the other.

Another embodiment involves controlling the gradient balance by lowering the sensitization (i.e. sensitizer level or time-temperature of the digestion step) of that portion of the emulsion containing the high red sensitizing dye. It is preferred to digest this portion of the emulsion from 15% to 60% of the time used to digest that containing the panchromatic sensitizing dye. In this embodiment, the dyes are preferably added during the digestion step, although they may be incorporated at any point during the preparation of the emulsion after the precipitation has occurred and the binder added thereto. The emulsions are then combined in the desired amount and coated as a single layer on a suitable support.

Photographic silver halide films made as described above demonstrate a unique ability to process to the desired gradient balance (as determined by the emulsion, dye and coating weight) under identical processing conditions. Thus, the desired gradient balance is achieved in the emulsion, and it is not necessary to vary the processing conditions which would introduce difficulty in obtaining reproducible results therefrom.

In cases where chemical sensitization, temperatures and times are identical, it is convenient to add the spectral sensitizers after chemical sensitization has been completed. This permits one to sensitize the emulsion prior to separation enabling a more uniform product to be achieved. When it is required that the emulsion be divided (i.e. to reduce sensitization in one portion), the spectral sensitizers may be added either before, during or after chemical sensitization occurs.

The emulsions disclosed herein may be coated by any of the means disclosed in the prior art (i.e. skim, airknife, bar or falling film coating techniques) on any suitable support including glass, cellulose acetate, cellulose nitrate and other synthetic film forming resins or polymers (e.g. polyester, polyamides, polystyrene, etc.). The suport may also contain an antihalation layer coated thereon, in fact it is so preferred.

In the following specific examples, the emulsions, except for Example 6, are of the ammonia-ripened variety. It will be understood that the sensitization (also called "digestion") step involves a treatment of the emulsion in the presence of gold and sulfur for a time and at a temperature necessary to give the desired photographic speed and fog level. The times and temperatures of sensitization treatments will vary with the emulsion type and are generally in the range of 30 to 60 minutes and 130° to 160° F. At the end of the sensitization step, the emulsion is cooled to a temperature convenient for the addition of other ingredients e.g. coating aids, hardeners, antifoggants etc. The emulsion is stirred and then held at or below the temperature of addition until coating. Where sensitizing dye is added after the sensitization (digestion step) the emulsion is generally stirred for a few minutes to insure adequate dye distribution and adsorption as known to those skilled in the art.

In the following examples, a relative speed is calculated at the exposure necessary to give a net density of 0.3. Gradients are measured as the slope of a line between gross densities of 0.4 and 1.7.

This invention will now be illustrated by, but not limited to, the following examples.

EXAMPLE 1

This example is designed to demonstrate that films prepared from a single emulsion containing all the desired spectral sensitizers therein will produce a film element with undesirable color gradient balance for the color separation industry. It would be necessary, therefore, to subsequently adjust the developing conditions to achieve the desired gradient balance (e.g. red higher than green, green and blue approximately equal).

A silver halide, gelatino emulsion containing ca. 97 mole percent AgBr and ca. 3 mole percent AgI and about 200g. gelatin per 1.5 moles of silver halide was prepared and divided into two equal portions A and B. Portion A was digested with about 450 mg./1.5 moles of silver halide, of Dye A (shown previously) for about 10 minutes at about 100° F. Portion B was further equally divided and one half treated with Dye A as described above and then the other half of this portion recombined therewith. Portion B was treated thus so as to provide emulsion grains which were not fully exposed to the panchromatic spectral sensitizers. Both Portion A and Portion B were then chemically sensitized with gold and sulfur at elevated temperatures (about 130° F.), cooled and about 75 mg./1.5 moles of silver halide each of high red spectral Dye B (shown previously) was added to each portion. The usual wetting and coating aids, hardeners, antifoggants, etc. were added to each portion and the emulsions were coated on separate polyester film supports. A thin protective top coat was also applied thereon and the films thus coated were dried. Samples from each coating were given an approximate 30 second exposure through a 2 step wedge to a pulsed xenon arc lamp through a 0.6 neutral density filter at the source at a distance of about 6 feet. Three samples of each film were exposed through a Wratten 47B filter, a Wratten 58 filter or a Wratten 25 filter respectively followed by machine prcessing in a Pako G-24 automatic processor containing a continuous tone mixed developer (e.g. metol-hydroquinone and the like). Processing time in the processor is about 2 minutes at 80° F. and includes the steps of developing, fixing, washing and drying. The following results were obtained:

| | | Speed | | | Gradient | | |
|---|---|---|---|---|---|---|---|
| Sample | Fog | Red | Green | Blue | Red | Green | Blue |
| Portion A | .07 | 100 | 54 | 57 | 1.96 | 2.18 | 1.77 |
| Portion B | .08 | 71 | 38 | 44 | 1.99 | 2.15 | 1.80 |

Thus it can be seen that incorporation of both spectral sensitizers within the single emulsion, even when a portion of that emulsion is withheld to allow maximum contact of non-sensitized grains with the second spectral sensitizer, results in an undesirable gradient balance which must then be corrected by adjustment of processing conditions.

EXAMPLE 2

An emulsion similar to that described in Example 1 was prepared and split into two equal portions. The first portion was digested with gold and sulfur and about 450mg./1.5 moles of silver halide, of Dye A while the second portion was digested only with gold and sulfur. After cooling both portions about 75mg./1.5 moles of silver halide of Dye B was added to the second portion and this portion was mixed thoroughly for about 5 minutes to insure proper contact of the dye with the silver halide grains. Both portions were then treated with the usual after-additions (wetting aids, antifoggants etc.) and then were recombined and thoroughly mixed just prior to coating as a single layer on a polyester film base. A gel overcoat was also applied thereon and the coated film was dried. Samples were exposed and processed as described in Example 1 with the following results:

| | Speed | | | Gradient | | |
|---|---|---|---|---|---|---|
| Fog | Red | Green | Blue | Red | Green | Blue |
| .10 | 54 | 47 | 44 | 2.00 | 1.86 | 1.86 |

This example demonstrates, when compared to Example 1, that the desired gradient balance can be achieved in the emulsion by a separate preparation to insure adequate dye coverage on separate silver halide grains. This prevents unwanted dye migration.

EXAMPLE 3

Example 2 was repeated except that the coating weight of the silver halide layer was increased by 30%. The following results were obtained:

| | Speed | | | Gradient | | |
|---|---|---|---|---|---|---|
| Fog | Red | Green | Blue | Red | Green | Blue |
| .11 | 50 | 47 | 44 | 2.25 | 1.98 | 1.96 |

Here it is seen that although the gradients increased because of the higher coating weight the desired gradient balance is not a function of the coating weight of the silver halide layer.

EXAMPLE 4

An emulsion similar to that of Example 1, except that the average grain size was larger by about 20%, was prepared ans plit into two equal portions and each portion was treated as described in Example 2. After recombining, coating, overcoating, drying, exposing and developing samples as described in Example 2 the following results were obtained:

| | Speed | | | Gradient | | |
|---|---|---|---|---|---|---|
| Fog | Red | Green | Blue | Red | Green | Blue |
| .13 | 100 | 87 | 93 | 1.65 | 1.49 | 1.48 |

EXAMPLE 5

An emulsion similar to that described in Example 4 was prepared and divided into 2 portions. Portion A was sensitized with gold and sulfur and 400 mg. of dye A/1.5 moles of silver halide. Portion B was also sensitized with gold and sulfur and 200 mg. of dye B/1.5 moles of silver halide added after the sensitization step. The usual after additions were made and 55 parts of A were mixed with 45 parts of B prior to coating on a polyester film support. The film was overcoated, dried, sampled, exposed and developed as previously described with the following results:

| | Gradient | | |
|---|---|---|---|
| Sample | Red | Green | Blue |
| 55 parts A + 45 parts B | 1.93 | 1.62 | 1.63 |

This example demonstrates that the gradient balance desired can be achieved by increasing the dye concentration and lowering the amount of emulsion used for that portion respectively.

EXAMPLE 6

A photographic gelatino silver halide emulsion containing 96.3 mole percent silver bromide and 3.7 mole percent silver iodide and about 200g. of gelatin/1.5 moles of silver halide was prepared and split into two equal portions. Gold and sulfur sensitizers were added to each portion. To portion A (the red-blue portion) there were added 300 mg./1.5 moles silver halide of a dye with the following structure:

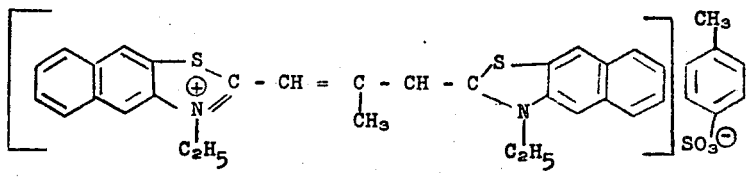

while to portion B (the panchromatic portion) 500 mg/1.5 moles of silver halide of Dye A (described earlier) were added. Both portions were digested at elevated temperatures for a period of time, cooled and the usual wetting and coating aids, hardeners and antifoggants added, and samples of the emulsions were coated individually on a suitable polyester film support and also as a double layer element on the same support with the panchromatic portion being applied second. A thin protective top coat of gelatin was applied to each coating and the elements were dried. Samples from each coating were given a 1/25 sec. exposure to a tungsten light source through a 2 step wedge and either a Wratten 47B filter, a Wratten 58 filter or a Wratten 25 filter respectively followed by developing 5 minutes using a strip machine in a continuous tone developer (e.g. metol-hydroquinone mixed developer). After fixing and drying the following results were obtained:

| Coating Weight[1] Portion A | Portion B | Speed Fog | Red | Green | Blue | Gradient Red | Green | Blue |
|---|---|---|---|---|---|---|---|---|
| 28.6 | — | .13 | 47 | 7 | 13 | .89 | .82 | .66 |
| 0 | 37.0 | .24 | 71 | 50 | 25 | 1.01 | 1.02 | .81 |
| 28.6 (bottom) | 36.3 (top) | .26 | 100 | 71 | 38 | 1.60 | 1.24 | 1.16 |

[1]as mg. silver halide/dm².

EXAMPLE 7

An ammonia-ripened, silver iodobromide emulsion containing ca. 3.1 mole percent AgI was split into two equal portions and each portion brought to its optimum sensitivity with gold and sulfur. One portion was further treated with 100 mg./1.5 moles of silver halide of Dye B (red-blue sensitive portion) while the other portion was treated with 100 mg. of Dye B/1.5 moles of silver halide plus 100 mg./1.5 moles of silver halide of a green sensitizing dye with the following structure:

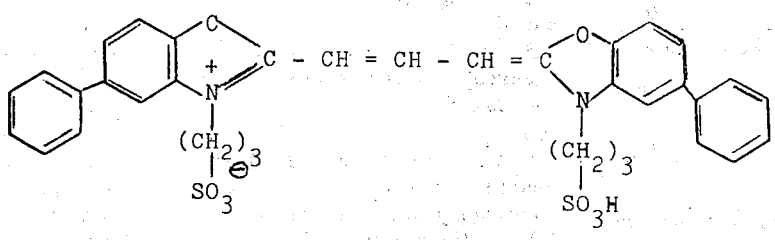

3,3′-disulfopropyl-5,5′-diphenyloxacarbocyanine, which served to render this portion of emulsion panchromatic in spectral response. The usual after-additions were also added to both portions and the emulsions coated as shown below. After coating, overcoating and drying, samples from each coating were exposed as in Example 6 for 15 sec. and processed as in Example 1 for 1½ min. with the following results:

| Sample | Fog | Speed Red | Green | Blue | Gradient Red | Green | Blue |
|---|---|---|---|---|---|---|---|
| Single layer, 100% panchromatic portion | .14 | 100 | 41 | 25 | 1.26 | 1.18 | 1.03 |
| Dual layer, 47.8% of coating is panchromatic on top of red-blue layer | .14 | 132 | 50 | 31 | 1.49 | 1.28 | 1.23 |

EXAMPLE 8

Example 7 was repeated with a 3.7% iodide emulsion containing 100 mg. Dye B/1.5 moles of silver halide (the red-blue portion) and the other portion containing 260 mg./ Dye A/1.5 moles of silver halide (the panchromatic portion). This example was coated as a dual layer element as shown below. Samples from the coating were processed as described in Example 7 with the following results:

| Sample | Fog | Speed Red | Green | Blue | Gradient Red | Green | Blue |
|---|---|---|---|---|---|---|---|
| Single layer, 100% panchromatic portion | .10 | 100 | 76 | 38 | .91 | .99 | .76 |
| Dual layer, 40% of coating is panchromatic on top of red-blue layer. | .10 | 162 | 76 | 44 | 1.06 | .96 | .92 |

EXAMPLE 9

Example 8 was repeated except that the red-blue portion contained only 80 mg. of Dye B/1.5 moles of silver halide. The following results were obtained:

| Sample | Fog | Speed | | | Gradient | | |
|---|---|---|---|---|---|---|---|
| | | Red | Green | Blue | Red | Green | Blue |
| Single layer, 100% panchromatic portion | .10 | 100 | 76 | 38 | .91 | .99 | .76 |
| Dual layer, 80% of coating is panchromatic on top of red-blue layer. | .07 | 132 | 54 | 41 | 1.06 | .94 | .93 |

EXAMPLE 10

An emulsion containing ca. 3.7 mole percent AgI and ca. 96.3 mole % AgBr was prepared and split into four equal portions. Each portion contained the same level of gold and sulfur and was digested at 135° F. The level of sensitizing dye added and the time digested was vaired as follows:

| Portion | A | B | C | D |
|---|---|---|---|---|
| Dye A added (mg/1.5 moles of AgX) | 200 | 400 | None | None |
| Dye B added (mg/1.5 moles AgX) | None | None | 100 | 200 |
| Digestion Time (min.) | 40 | 40 | 10 | 10 |
| Sensitivity | Panchromatic | | Red-Blue | |

After the emulsions had been sensitized as shown, the usual coating and wetting aids along with hardeners and anti-foggants were added. The emulsions were mixed as shown below and coated, overcoated, dried, sampled, exposed and processed as described in Ex. 6 with the following results:

| Sample | Emulsion Used | Gradient | | |
|---|---|---|---|---|
| | | Red | Green | Blue |
| 1 | 100% A | .84 | .81 | .63 |
| 2 | 100% B | .71 | .65 | .54 |
| 3 | 100% C | Only toe developed | | |
| 4 | 100% D | | | |
| 5 | 50% A + 50% C | 1.00 | .87 | .85 |
| 6 | 50% A + 50% D | 1.00 | .85 | .81 |
| 7 | 50% B + 50% C | 1.01 | .84 | .89 |
| 8 | 50% B + 50% D | .86 | .85 | .79 |

Thus it has been demonstrated that gradient balance can be controlled by preparing emulsions as described, and it is subsequently not necessary to change the processing conditions. Different gradient balances may be achieved by using different spectral sensitizers or varying the amount of emulsion used in mixing (for single layers) or in dual layers. All of the elements described herein are particularly useful for preparing color separation negatives and can be concurrently processed in the same machine to produce the gradients desired by that industry without change in processing conditions.

What is claimed is:

1. A black-and-white silver halide color-separation film in which the various colored gradients are balanced in relation to each other when all color records are machine-processed under identical processing conditions, which comprises a support coated with at least two black-and-white silver halide emulsions, either mixed or in separate layers and prepared from the same halides, one of said emulsions containing a fully panchromatic spectral sensitizer and another emulsion containing a sensitizer more sensitive to the visible red region of the spectrum than the green, and wherein the red gradient of the film is greater than the blue and green gradients, and the blue and green gradients are substantially equal.

2. The film of claim 1 wherein said emulsions are mixed.

3. The film of claim 1 wherein said emulsions are chemically as well as optically sensitized.

4. The film of claim 1 wherein said emulsions are coated in separate layers.

5. The film of claim 1 wherein the panchromatic spectral sensitizer is 3,3′-disulfopropyl-9-methylthiacarbocyanine and the other spectral sensitizer is 3,3′-disulfopropyl-5,5′-dimethyl-9-ethyl-thiacarbocyanine.

6. A process for the preparation of a black-and-white silver halide color-separation film in which the various colored gradients are balanced in relation to each other when all color records are machine-processed under identical processing conditions which comprises both chemically and optically sensitizing at least two silver halide emulsions either separately or as a mixture on a film support, one of said emulsions being optically sensitized with a fully panchromatic spectral sensitizer and another of said emulsions being sensitized more strongly to the visible red region of the spectrum than the green, the red gradient of the film being greater than the blue and green gradients, and the blue and green gradients being substantially equal.

7. The process of claim 6 wherein the optical sensitization is carried out by adding a dye sensitizing more strongly to the visible red region of the spectrum to one emulsion during digestion of the emulsion, and adding a fully panchromatic spectral sensitizing dye to the other emulsion during digestion.

8. The process of claim 6 wherein the emulsion sensitized with the fully panchromatic spectral sensitizer contains 3,3′-disulfopropyl-5,5′-dimethyl-9-ethylthiacarbocyanine and 3,3′-disulfopropyl-5,5′-diphenylopacarbocyanine.

9. The process of claim 8 wherein the dye sensitizing more strongly to the visible red region of the spectrum is digested for a period of from 15–60% of the time used to digest the panchromatically sensitized emulsion.

* * * * *

UNITED STATES PATENT OFFICE

CERTIFICATE OF CORRECTION

PATENT NO. : 3,992,210

DATED : November 16, 1976

INVENTOR(S) : Warren William Evans

It is certified that error appears in the above-identified patent and that said Letters Patent are hereby corrected as shown below:

| Patent Column | Line | Corrections |
|---|---|---|
| 2 | 16 | after "and" insert -- - -- |
| 6 | 37 | before "2" insert -- √ -- |
| 6 | 42 | change "prcessing" to -- processing -- |
| 7 | 52 | after "desired" add -- gradient balance was maintained. Therefore the -- |
| 7 | 59 | change "ans" to -- and -- |
| 8 | 63 | after "a" insert -- √ -- |
| 11 | 44 | "Only toe developed" should be centered between C&D in table |
| 12 | 41 | after "emulsions" add -- prepared from the same halides, and coating said emulsions -- |
| 12 | 59 | change "opacarbocyanine" to -- oxacarbocyanine |

Signed and Sealed this

Fifteenth Day of February 1977

[SEAL]

*Attest:*

RUTH C. MASON
*Attesting Officer*

C. MARSHALL DANN
*Commissioner of Patents and Trademarks*